US007399566B2

(12) United States Patent
Padunchwit et al.

(10) Patent No.: US 7,399,566 B2
(45) Date of Patent: Jul. 15, 2008

(54) COLOR TONER AND DEVELOPER COMPOSITIONS AND PROCESSES FOR MAKING AND USING SUCH COMPOSITIONS

(75) Inventors: Itipon Padunchwit, Minburi (TH); Gordon Boon Ann Lim, Singapore (SG); Jusong Xia, Moore, SC (US); Kim Ieng Goh, Singapore (SG); Kheng Teck Chan, Singapore (SG)

(73) Assignee: Milliken & Company, Spartanburg, SC (US)

( * ) Notice: Subject to any disclaimer, the term of this patent is extended or adjusted under 35 U.S.C. 154(b) by 384 days.

(21) Appl. No.: 11/037,592

(22) Filed: Jan. 18, 2005

(65) Prior Publication Data

US 2006/0160009 A1 Jul. 20, 2006

(51) Int. Cl.
*G03G 9/10* (2006.01)

(52) U.S. Cl. ..... 430/107.1; 430/108.1; 430/108.21; 430/108.23

(58) Field of Classification Search ..... 430/107.1, 430/108.1, 108.21, 108.23
See application file for complete search history.

(56) References Cited

U.S. PATENT DOCUMENTS

| | | | | |
|---|---|---|---|---|
| 2,221,776 | A | 11/1940 | Carlson | 95/5 |
| 2,297,691 | A | 10/1942 | Carlson | 95/5 |
| 2,618,552 | A | 11/1952 | Wise | 95/1.9 |
| 2,874,063 | A | 2/1959 | Greig | 117/17.5 |
| 3,157,663 | A | 11/1964 | Kuhn | 260/200 |
| 3,743,503 | A | 7/1973 | Goldman et al. | |
| 3,909,258 | A | 9/1975 | Kotz | 96/1 R |
| 4,284,729 | A | 8/1981 | Cross et al. | 521/158 |
| 4,562,135 | A | 12/1985 | Winnik et al. | 430/106 |
| 4,640,690 | A | 2/1987 | Bumgartner et al. | 8/506 |
| 4,645,727 | A | 2/1987 | Ong et al. | 430/106 |
| 4,654,727 | A | 3/1987 | Blum et al. | 360/71 |
| 4,778,742 | A | 10/1988 | Ong et al. | 430/106 |
| 4,797,339 | A | 1/1989 | Maruyama et al. | 430/109 |
| 4,812,141 | A | 3/1989 | Bumgartner et al. | 8/506 |
| 4,954,410 | A | 9/1990 | Takuma et al. | 430/109 |
| 5,092,894 | A | 3/1992 | Kenny | 623/18 |
| 5,176,745 | A | 1/1993 | Moore et al. | 106/22 R |

(Continued)

FOREIGN PATENT DOCUMENTS

EP 0 546 857 A1 6/1993

(Continued)

OTHER PUBLICATIONS

Derwent Abstract XP002382210 (for JP 04-330462A), Derwent Publications, Ltd.

*Primary Examiner*—Mark A Chapman
(74) *Attorney, Agent, or Firm*—Terry T. Moyer; Robert M. Lanning

(57) ABSTRACT

The invention provides novel colored toner and developer compositions containing polymeric colorants. Such compositions may contain poly(oxyalkylene) or poly(alkylester) substituted color chromophores which are attached to relatively long chained ologomers. The color toner and developer compositions of the invention resist color bleeding and aggregation, and may retain their color fidelity over extended time periods. Such color toner compositions are useful in color imaging systems. The invention provides novel compositions that can readily be formulated and manufactured using the polymeric or oligomeric colorants. The toners of the invention may contain charge control agents, thermoplastic resins, colorants, and additives.

14 Claims, 1 Drawing Sheet

U.S. PATENT DOCUMENTS

| | | | | |
|---|---|---|---|---|
| 5,200,290 | A | 4/1993 | Ong et al. | 430/115 |
| 5,290,654 | A | 3/1994 | Sacripante et al. | 430/137 |
| 5,290,694 | A | 3/1994 | Nakanishi et al. | 435/198 |
| 5,296,325 | A | 3/1994 | Ohtsuka et al. | 430/106 |
| 5,308,734 | A | 5/1994 | Sacripante et al. | 430/137 |
| 5,352,521 | A | 10/1994 | Hotta et al. | 428/402 |
| 5,418,108 | A | 5/1995 | Kmicck-Lawrynowicz et al. | 430/137 |
| 5,429,841 | A | 7/1995 | Batlaw et al. | 427/288 |
| 5,434,030 | A | 7/1995 | Smith et al. | 430/106 |
| 5,437,949 | A | 8/1995 | Kanbayashi et al. | 430/45 |
| 5,470,687 | A | 11/1995 | Mayama et al. | 430/137 |
| 5,500,321 | A | 3/1996 | Kasnya et al. | 430/109 |
| 5,565,298 | A | 10/1996 | Sugura et al. | 430/137 |
| 5,744,520 | A | 4/1998 | Kmiecik-Lawrynowicz et al. | 523/334 |
| 5,843,609 | A | 12/1998 | Borzo et al. | |
| 5,948,152 | A | 9/1999 | Zhao et al. | 106/31.43 |
| 5,955,523 | A | 9/1999 | Stephens et al. | 524/167 |
| 5,977,210 | A | 11/1999 | Patel et al. | 523/161 |
| 6,090,973 | A | 7/2000 | Borzo et al. | |
| 6,153,345 | A | 11/2000 | Soeda et al. | 430/106 |
| 6,270,993 | B1 | 8/2001 | Shibuya et al. | 435/69.1 |
| 6,350,305 | B1 | 2/2002 | King et al. | 106/31.29 |
| 6,350,552 | B1 * | 2/2002 | Livengood et al. | 430/108.22 |
| 6,387,583 | B1 | 5/2002 | Yoon | 430/137.16 |
| 6,437,155 | B2 | 8/2002 | Titterington et al. | 552/238 |
| 6,447,591 | B1 | 9/2002 | Titterington et al. | 106/31.29 |
| 6,492,533 | B1 | 12/2002 | Connor et al. | 549/299 |
| 6,544,705 | B2 | 4/2003 | Kim et al. | 430/109.4 |
| 6,566,425 | B1 | 5/2003 | Connor et al. | 524/83 |
| 6,664,311 | B2 | 12/2003 | Batlaw | 523/160 |
| 6,737,450 | B2 | 5/2004 | Batlaw | 523/160 |
| 6,764,541 | B1 | 7/2004 | Banning et al. | 106/31.29 |
| 6,780,559 | B2 | 8/2004 | Veregin et al. | 430/137.14 |
| 6,790,267 | B1 | 9/2004 | Banning et al. | 106/31.29 |
| 6,794,426 | B2 | 9/2004 | Batlaw | 523/160 |
| 2004/0167250 | A1 | 8/2004 | Batlaw | |

FOREIGN PATENT DOCUMENTS

| | | | |
|---|---|---|---|
| JP | 04-330462 | A | 11/1992 |

* cited by examiner

COLOR TONER AND DEVELOPER COMPOSITIONS AND PROCESSES FOR MAKING AND USING SUCH COMPOSITIONS

FIELD OF THE INVENTION

This invention relates to novel color toner and developer compositions adapted for use in electrophotographic imaging devices to prepare latent electrostatic images, and processes for making such color toner compositions.

BACKGROUND OF THE INVENTION

Images may be formed on the surface of photoconductive materials by electrostatic processes. The electrophotographic imaging process involves producing a uniform electrostatic charge on a photoconductor, exposing it to a light and shadow image to dissipate the charge on the area, and then developing the resulting electrostatic latent image by depositing a finely divided electroscopic toner material. The toner material, or "toner" is electrically attracted to those areas of the photoreceptor which retain a charge, thereby forming a toner image corresponding to the electrostatic latent image. The developed image would then be transferred to a substrate such as paper, and permanently affixed to the substrate by heat, pressure, solvent or over-coating treatment. In the case of obtaining a multicolor image, such as making a colored photocopy, an original is first subjected to exposure through a color separation filter, and the process is then repeated by the use of color toners of yellow, magenta, cyan, and black, thereby forming a color image.

Toner materials may consist of binder resins, waxes or polyolefins, charge control agents, flow agents, pigments and/or dyes, and other additives. In a system in which a two-component developer is used, the toner particles may be employed in a mixture with solid carrier particles such as glass beads, iron powder or ferrite powder. The composition of toner and carrier is selected so that as a result of contact friction, the toner may experience a polarity reversal with respect to charge on the photoconductor layer. As a result of contact friction, the carrier electrostatically (triboelectrically) attracts the toner to its particle surfaces. This results in the transport of toner through a developing assembly and the feeding of the toner upon the photoconductive layer.

Dyes and pigments are suitable for some color toner applications. Such dyes and pigments may include organic dyes and pigments having relatively high tinting strength, good transparency, good thermal stability, and acceptable resin compatibility. Pigments may include: quinacridone, lithol rubine, rhodamine pigments for magenta, phthalocyanine blue pigments for cyan, and diarylide yellow pigments for yellow, among others.

There are problems and drawbacks when using pigments in toners. For example, a toner comprising an organic pigment that is insoluble in the resin may cause an undesirable decrease in the transparency or hue variation in the color of transmitted light. Improvements have been made to address this problem, including processes disclosed in U.S. Pat. Nos. 6,153,345 and 5,437,949. However, the use of pigments in toners to achieve color reproductions continues to represent a significant challenge in the toner manufacturing industry.

One advantage of selecting organic dyes instead of pigments for color toners is that dyes may exhibit increased color fidelity. This may be due to the degree to which the dyes may be molecularly dispersed in a binder resin. To obtain a homogeneous dispersion, it may be necessary to build into such molecules substituting groups for enhancing compatibility with the resin. Unless the dye molecules are substantially fully compatible with the resins, these molecules may have a tendency to aggregate over time when subjected to heat, pressure and humidity. This may result in a loss of color fidelity. The low molecular weight of the dye molecules may cause high mobility of the dyes in the resin, resulting in undesirable bleeding of the dyes. Thus, the use of dyes in toner applications also may provide drawbacks and disadvantages.

There is continuing long felt need in the industry for toner compositions and toner processes that are capable of achieving a balance of relatively high resolution, low cost, reduced environmental risk, low levels of migration, reduced levels of bleeding, and more environmentally sound manufacturing processes. This invention addresses these needs in the industry.

DETAILED DESCRIPTION OF THE INVENTION

Figure 1:
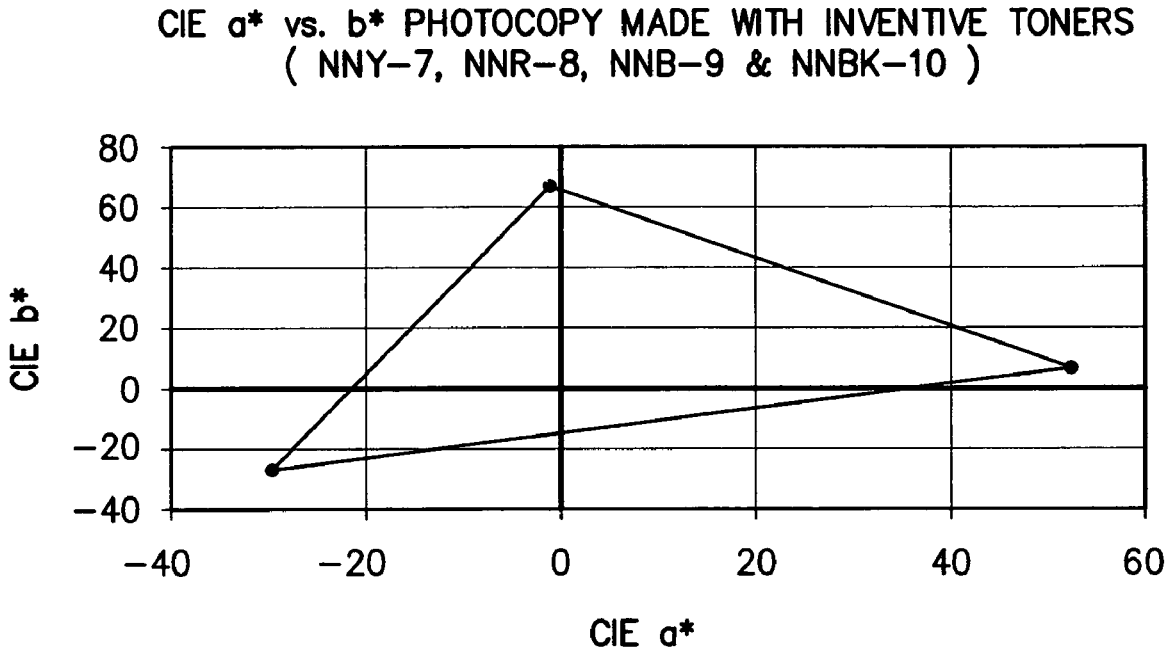
FIG. 1 is a graph showing color hues achievable using color toners of the invention.

The present invention provides novel colored ("color") toner and developer compositions containing polymeric colorants. Such compositions may contain poly(oxyalkylene) substituted color chromophores. The colored toner and developer compositions of the invention resist color bleeding and aggregation, and may retain their color fidelity over extended time periods, which is a significant advantage. Such color toner compositions are useful in color imaging systems. The invention provides novel and useful color toner and developer compositions that may be readily formulated and manufactured using polymeric colorants. The invention also relates to production processes for making colored toner and developer compositions using polymeric or oligomeric colorants.

The invention relates to color toner compositions comprising at least a resin and at least one polymeric colorant compatible with the resin, and at least one charge control agent. The resin may be mixed with the colorant. In other appications, the resin may be copolymerized with the colorant, forming a colored copolymer. A pulverization process may be employed to produce such a particulate toner for electrophotography, electrostatic recording or electrostatic printing. This invention is directed to polymeric colorant toner compositions for use in process color, laser printers and copiers. Methods of making such compositions are disclosed. Also disclosed are methods of using such inventive color toners and developer compositions in electrophotograpic printing applications.

Polymeric Colorants as Applied in Toners

Poly(oxyalkylene) substituted colorants are designated herein as "polymeric colorants" or polyalkyleneoxy-substituted chromophores. The invention is directed to the provision of toner and developer compositions of host binder resins, and at least one polymeric colorant of the formula (I)

$$\text{R-[E(oligomeric constituent-X)}_n\text{]}_m \qquad \text{(I)}$$

wherein R or R-E is an organic dyestuff radical and E is a linking moiety selected from the group consisting of N, O, S, $SO_3$, $SO_2N$ or $CO_2$, and the like.

The "oligomeric constituent" may be selected from:

(1) divalent oligomeric alkylene oxide radicals and their copolymers of oligomeric alkylene oxides in which the alkylene moiety of the "oligomeric constituent" contains two or more carbon atoms, and such an "oligomeric constituent" has a molecular weight of from 44 to about 3000, in which the "alkylene oxides" are exemplified by ethylene oxide, propylene oxide, butylenes oxide, glycidol and their derivatives;

(2) divalent aliphatic oligomeric ester radicals having the structure represented as formula (II)

(II)

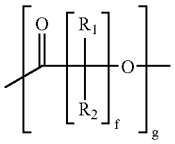

wherein $R_1$ and $R_2$ each are independently selected from H or $C_1$-$C_{10}$ alkyl groups; f comprises integer between 1 and 10; and g comprises any positive integer and fraction between 1 and 20; and (3) a combination of "oligomeric alkylene oxide radicals" and "aliphatic oligomeric ester redicals" as defined herein;

The X group may be an end group, and is not believed to be critical with regard to the functioning of the colorants in toner compositions. For example, the end group may be selected from, H, OH, SH, $NH_2$, alkyl, aryl, alkyl esters, aryl esters, organic sulfonates and sulfates, amides; n and m may be independently selected from integers between 1 and 5.

Another embodiment of the invention is accomplished by providing toner and developer compositions comprised of a host binder resin(s) and at least one polymeric colorant species of the formula (III)

$$[R(G^{\ominus})_h][(R^*)_k\text{-}M^{\oplus}\text{-(oligomeric constituent-X)}_j]_h \quad \text{(III)}$$

wherein R or $R(G)_h$ is a dyestuff radical; G is selected from groups consisting of —$SO_3$ or —$CO_2$; R* is H, alkyl or aryl groups; M is nitrogen atom or phosphorus; X and "oligomeric constituent" are as defined above; h is an integer between 1 and 4; k is an integer between 0 and 5, and j is an integer between 1 and 6, in which (k+j)=4 when M is a nitrogen and (k+j)=6 when M is phosphorus.

In one embodiment of the invention, a color toner composition is adapted for electrophotographic printing comprising: (a) at least one thermoplastic resin; (b) a charge control agent; and (c) a polymeric colorant. The polymeric colorant may be selected from the group consisting of: methine-based colorants, azo-based colorants, benzodifuranone-based colorants, copper phthalocyanine-based colorants, and triphenylmethane-based colorants.

As examples, several different chemical classes of polymeric colorants are useful in the practice of the invention, as further described below.

Methine-Based Polymeric Colorants

Methine-based polymeric or colorants may be represented as the structure formula (IV) below:

(IV)

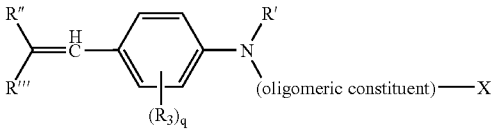

wherein R' is selected from a group consisting of hydrogen, alkyl, aryl, arylalkyl, alkylaryl, or a group represented as -(oligomeric constituent)-X, and wherein R' can be joined to the phenyl moiety to form a ring. Each $R_3$, independently of the others, may be a substituting group selected from a group consisting of halogen, hydrogen, alkyl, alkoxy, nitrile, nitro, amide, and a sulfonamide group; q may be an integer of 0, 1, 2, 3, or 4; R" and R'" each, independently of the other, may be selected from hydrogen, halogen, tertiary amino, imine, cyano, pyridinium, ester, amide, sulfate, sulfonate, sulfide, sulfoxide, phosphine, phosphinium, phosphate, nitrile, mercapto, nitro, sulfone, acyl, azo, cyano, alkyl, alkoxy, aryl, aryloxy, arylalkyl, arylakyloxy, alkylaryl, alkylaryloxy. X may be selected from H, OH, SH, $NH_2$, alkyl, aryl, alkyl esters, aryl esters, organic sulfonates and sulfates, and amides. The oligomeric constituent may be selected from the group of: alkylene oxide radicals and ester radicals.

Azo-Based Polymeric Colorants

Azo-based polymeric or oligomeric colorants may be represented as the structure of formula (V)

(V)

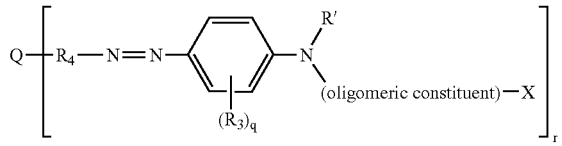

wherein R', $R_3$, oligomeric constituent, X and q are all as defined above with respect to the methine-based structure; $R_4$ is an aromatic- or heteroaromatic-containing group; Q is a hydrogen, or a linking group selected from the group consisting of O, S, CO, $SO_2$, $C_1$-$C_8$ alkyl, $C_2$-$C_8$ alkene, p-phenylenediamine, m-hydroxybenzene, and m-di($C_1$-$C_4$ alkoxybenzene; and r may be 1 or 2.

Triphenylmethane-Based Polymeric Colorants

Triphenylmethane-based polymeric colorants useful in the practice of the invention may be represented as the structure formula (VI)

(VI)

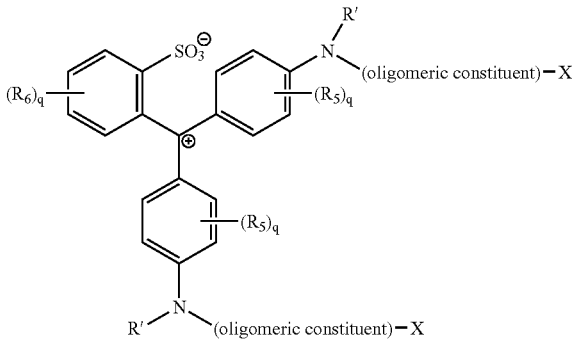

wherein R', oligomeric constituent, X and q are as defined previously; each $R_5$ is independently from each other and is a group selected from the group consisting of hydrogen, halogen, alkyl, alkoxy, alkylamino, and arylamino; each $R_6$, independently of the others, is a group selected from the group consisting of hydrogen, halogen, alkyl, alkoxy, alkylamino, arylamino, cyano, nitro, amide, $SO_3$ and a sulfonamide group.

Phthalocyanine-based polymeric or oligomeric colorants may be represented as the above mentioned structure formula (III) in which R is a metal phthalocyanine derivative radical.

Benzodifuranone-Based Polymeric Colorants

Benzodifuranone-based polymeric or oligomeric colorants that may be used in the practice of the invention include those represented as structure formula (VII)

(VII)

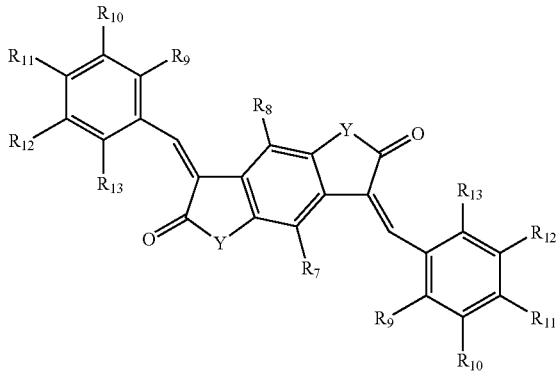

wherein Y is selected from the group consisting of O, S, $NR_{14}$ and wherein $R_{14}$ is an hydrogen, an alkyl or an aryl; $R_7$ and $R_8$ are the same or different and are independently selected from a group consisting of hydrogen, alkyl, halogen, alkenyl, hydroxy, and alkoxy; and $R_9$, $R_{10}$, $R_{11}$, $R_{12}$, and $R_{13}$ are the same or different and are selected from the group consisting of hydrogen, $C_{1-20}$ alkyl, $C_{1-20}$ alkylester, halogen, hydroxyl, hydrogen, thio, cyano, sulfonyl, sulfo, sulfato, aryl, nitro, carboxyl, $C_{1-20}$ alkoxy, $C_{1-20}$ alkylamino, acrylamino, $C_{1-20}$ alkylthio, $C_{1-20}$ $C_{1-20}$ alkylsufonyl, $C_{1-20}$ alkylphenyl, phosphonyl, $C_{1-20}$ alkylphosphonyl, $C_{1-20}$ alkoxycarbonyl, phenylthio, and E-(oligomeric constituent-X)$_n$, wherein at least one of $R_9$ to $R_{13}$ is E-(oligomeric constituent-X)$_n$ wherein E, X, n and "oligomeric constituent" are as defined above. Preferably, $R_{11}$ is E-(oligomeric constituent-X)$_n$.

Specific Compositions and Applications

The colored toner and developer compositions comprise at least one binder resin and at least one polymeric or oilgomeric colorant that is selected from chromophores consisting of methines as represented by structure formula (VIII), azos as represented by structure formula (IX), bisazos as represented by structure formula (X), triphenylmethanes as represented by structure formula (XI), copper phthalocyanine derivatives, or benzodifuranones as represented by structure formula (XII). Thus, depending upon the particular application, many different compounds may be effectively employed in the toner compositions of the invention.

Methine-based polymeric or oligomeric colorants that are useful may be represented by structure formula (VIII)

(VIII)

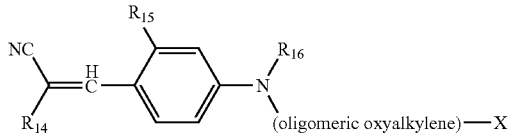

wherein X is as defined previously; $R_{14}$ is a group selected from the group consisting of cyano, nitro, alkylcarbonyl, arylalkylcarbonyl, alkoxycarbonyl, arylalkoxycarbonyl, amide, alkylamide, etc; $R_{15}$ is a group selected from a group consisting of hydrogen, $C_1$-$C_{20}$ alkyl, $C_7$-$C_{20}$ arylalkyl, etc; $R_{16}$ is selected from a group consisting of hydrogen, $C_1$-$C_{20}$ alkyl, aryl, $C_7$-$C_{20}$ arylalkyl, $C_7$-$C_{20}$ alkylaryl, or a group represented as -(oligomeric oxyalkylene)-X wherein the divalent "oligomeric oxyalkylene" is as defined previously.

Azo-based polymeric or oligomeric colorants that are useful in toners may be represented by structure formula (IX)

(IX)

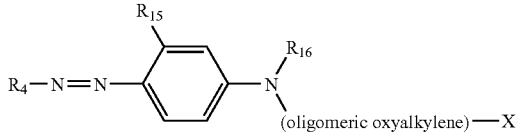

wherein $R_4$, $R_{15}$, $R_{16}$, X and "oligomeric oxyalkylene" as defined previously.

Bisazo-based polymeric or oligomeric colorants that are useful in the practice of the invention may be represented by structure formula (X)

(X)

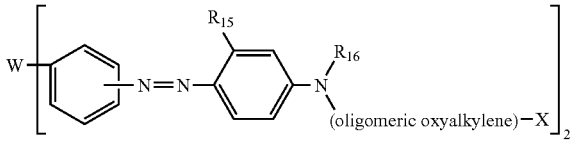

wherein W is a linking group and is selected from the group consisting of O, S, $SO_2$, CO, $C_1$-$C_8$ alkyl, $C_2$-$C_8$ alkylene, and p-phenylenediamine; $R_{15}$, $R_{16}$, X and "oligomeric oxyalkylene" may be provided as defined previously.

Triphenylmethane-based polymeric or oligomeric colorants that are useful in the practice of the invention may be represented as structure formula (XI)

(XI)

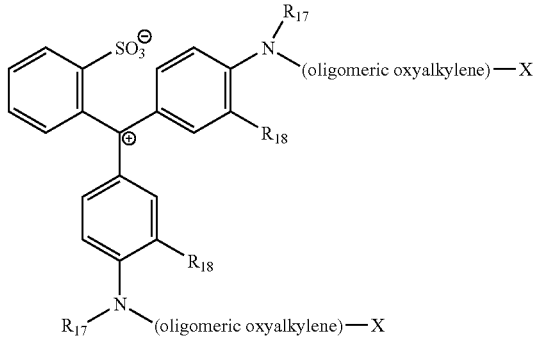

wherein X and the "olygomeric oxyalkylene" are as defined previously; $R_{18}$ is a group selected from the group consisting of hydrogen, halogen, alkyl, alkoxy, alkylamino, and arylamino; $R_{17}$ is selected from a group consisting of hydrogen, alkyl, aryl, arylalkyl, alkylaryl, or a group represented as -(oligomeric oxyalkylene)-X, and wherein $R_{17}$ can be joined to $R_{18}$ to form a ring.

Phthalocyanine-based polymeric or oligomeric colorants may be represented as the above mentioned structure formula (III) in which R is a copper phthalocyanine radical, G is $SO_3$, h=j=k=2, R* is $C_1$-$C_{20}$ alkyl, M is nitrogen, the "oligomeric constituent" is "oligomeric oxyalkylene" which is as defined previously, X is as defined previously.

Benzodifuranone-based polymeric or oligomeric colorants are represented as structure formula (XII)

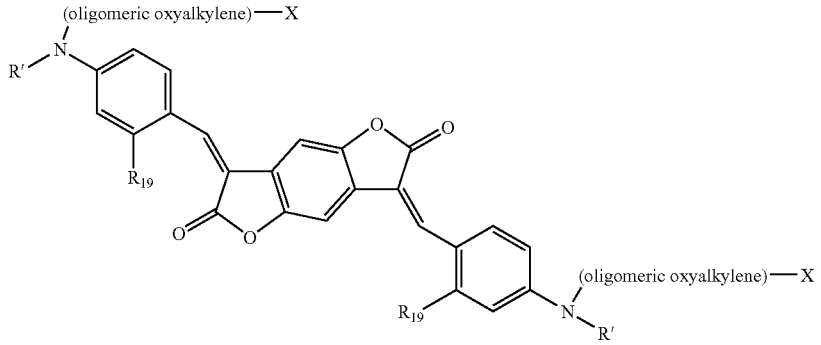

(XII)

wherein R', X and the "oligomeric oxyalkylene" are as defined previously; $R_{19}$ is selected from the group consisting of hydrogen, halogen, alkoxy, alkylamino, $(R_{20})C(O)NH$— wherein $R_{20}$ is selected from a group consisting of hydrogen, alkyl and aryl.

The colored toner and developer compositions may comprise binder resins and at least one polymeric or oilgomeric colorant selected from chromophores consisting of methines as represented by structure formula (VIII) wherein $R_{14}$ is an cyano or a $C_1$-$C_{10}$ alkylcarbonyl group, wherein $R_{15}$ is a hydrogen or a methyl group, wherein $R_{16}$ is -(oligomeric oxyalkylene)-X, and X is as defined previously; azos as represented by structure formula (IX) wherein $R_4$ is an aromatic- or heteroaromatic-containing group, wherein $R_{15}$ is a hydrogen or a methyl group, wherein $R_{16}$ is -(oligomeric oxyalkylene)-X, and X is as defined previously; bisazos as represented by structure formula (X) wherein W is $SO_2$, wherein $R_{15}$ is a hydrogen or a methyl group, wherein $R_{16}$ is -(oligomeric oxyalkylene)-X, and X is as defined previously; triphenylmethanes as represented by structure formula (XI) wherein $R_{18}$ is H, wherein $R_{17}$ is -(oligomeric oxyalkylene)-X, and X is as defined previously; phthalocyanines as represented by structure (III) wherein R is a copper phthalocyanine radical, G is $SO_3$, h=j=k=2, R* is independent to each other, and is selected from a group consisting of methyl, $C_{14}$-$C_{20}$ alkyl, M is nitrogen, the "oligomeric constituent" is "oligomeric oxyalkylene" which is as defined previously, X is as defined previously as well; and benzodifuranones as represented by structure formula (XII) wherein $R_{19}$ hydrogen or methyl group, R' is -(oligomeric oxyalkylene)-X, and X is as defined previously.

In the present invention, in addition to the polymeric colorants of the formula (I) and (III), other agents can be used in combination with the polymeric colorants to control the color hue. These agents include conventionally known pigments and dyes. Examples of blue agents include, but are not limited to, phthalocyanine C.I. Pigment Blue 15:3 and indanthrone C.I. Pigment Blue 60; examples of red agents include, but not limited to, quinacridone C.I. Pigment Red 122, azo C.I. Pigment Red 22, C.I. Pigment Red 48:1, C.I. Pigment Red 48:3 and C.I. Pigment Red 57:1; examples of the yellow agents include, but not limited to, azo C.I. Pigment Yellow 12, C.I. Pigment Yellow 13, C.I. Pigment Yellow 14, C.I. Pigment Yellow 17, C.I. Pigment Yellow 97, C.I. Pigment Yellow 155, benzimidazolone C.I. Pigment Yellow 151, C.I. Pigment Yellow 154 and C.I. Pigment Yellow 180; examples of the black agents include, but are not limited to, carbon black and Solvent Black 27.

The amount of the polymeric colorants employed in a color toner composition depends upon the charge properties of the binding resin and other factors. Such factors may include whether or not other known agents are optionally employed, such as dyes and/or pigments for shade adjustment purposes. One factor to consider is the charge properties of additives (charge control agents) such as bis(4-tert-butyl salicylic acid) chromium II complex, N-octadecyl-pyridinium chloride, tetraoctylammonium chloride. Another factor is the polymeric colorant miscibility with the binding resin, and the manner of dispersion in the resin. The amount of the polymeric colorant employed is not limited to a specific weight range. However, the amount of the polymeric colorants needed may be in a concentration of about 0.1 to 30% by weight, and may also be in the range of about 1 to about 15% by weight, with respect to the binding resin.

Pigments and dyes described above may be used in combination with the polymeric colorants of the general formulas (I) and (III). For example, an orange toner can be produced by using in combination with the polymeric yellow colorant, and a bluish purple toner can be produced by using in combination with the polymeric cyan colorant. When using the polymeric colorants of the formulas (I) and (III) in combination with the other conventional agents, the amount of the polymeric colorants of the formulas (I) and (III) may be 10% by weight or more, or 20% by weight or more, and also can be 30% by weight or more.

Resins and Their Use

As the binding resin to which the color toner composition of the present invention is applied, many known thermoplastic resins may be employed so long as the resin reveals good charge properties and is suitably miscible with polymeric colorants represented by the general formulas (I) or (II).

Examples of suitable binding resins include, but are not limited to, styrene acrylic copolymer resins, homopolymers of styrene and substituted styrene such as polystyrene, poly-p-chlorostyrene and polyvinyltoluene, styrene copolymers such as styrene-vinylnaphthalene copolymer, styrene-methyl acrylate copolymer, styrene-ethyl acrylate copolymer, styrene-butyl acrylate copolymer, styrene-octyl acrylate, styrene-methyl methacrylate copolymer, styrene-ethyl methacrylate copolymer, styrene-butyl, methacrylate copolymer, styrene-methyl-alpha.-chlorobutyl methacrylate copolymer, styrene-acrylonitrile copolymer, styrene-vinyl methyl ether copolymer, styrenevinyl ethyl ether copolymer styrene-vinyl methyl ketone copolymer, styrene-butadiene copolymer, styrene-isopropylene copolymer, styrene-acrylonitrile-indene copolymer, styrenemaleic acid copolymer and styrene-maleate copolymer, polymethyl methacrylate, polybutyl methacrylate, polyvinyl chloride, polyvinyl acetate, polyethylene, polypropylene, polyester, polyurethane, polyamide, polyvinyl butyral, polyacrylic acid resin, rosin, modified rosin, terpene resin, phenolic resin, aliphatic and alicyclic hydrocarbon resin, aromatic petroleum resin, chlorinated paraffin and paraffin wax. Paraffin is a common name for a group of high molecular weight alkane hydrocarbons with the general formula $C_{n'}H_{2n'+2}$, where n' is greater than 20.

These compounds may be used alone or in the form of a mixture thereof. The glass transition temperature (Tg) of the binder resin employed in the present invention may be 50 degrees C. or higher, more preferably 55 degrees C. or higher, and the melting point may be 80 degrees C. or higher. In one embodiment, the melting point is within a range of 80-180 degrees C. The binder resins may be polystyrene, styrene butadiene copolymers with a styrene content of from about 70 to about 95 weight percent, styrene-acrylate copolymers, linear and cross-linked polyester, etc, and mixtures thereof.

Of particular interest in one preferred embodiment of the invention are blends of styrene acrylate copolymers with polyolefin or synthetic hard paraffin wax. As is noted above, any other blends of polystyrene, styrene butadiene copolymers, styrene acrylate copolymers, polyesters, polyamides, polyurethanes, etc thermoplastics, are also suitable for use in this invention.

The toner binder resins are present in the toner composition in an amount of from about 70 percent by weight to about 99 percent by weight, and may in other embodiments be present in an amount of from about 80 percent by weight to about 98 percent by weight.

Optional Wax Components and Other Additives

The toner may also contain a wax component to aid the anti-stick properties of the toner. Various natural and synthetic waxes may be used, such as carnauba wax, and polyethylene and polypropylene, and other natural and synthetic wax or wax-like materials available commercially from a number of suppliers. For example, one application of the invention employs in the toner a low molecular weight polypropylene wax component. This component need not always be used, however, depending upon the other parameters of the toner and the print engine. An additional amount of these waxes may be about 1 to 6% (weight) of the toner.

The toner may further contain as additives to aid in retarding tack filler material. This material may be a surface treated or untreated inorganic material such as various metal oxides or carbonates or equivalent materials which will perform in the same manner. For example, silicon dioxide, titanium dioxide, aluminum oxide, calcium carbonate, barium sulfate, cerium oxide, strontium titanate, and other such materials may be used. An addition amount of these may be from about 0.1 to 5% (weight) of the toner.

The toner containing the foregoing binder resin and polymeric colorants may optionally include other dyestuffs and/or pigments which will likely further include such additives as charge control agents, flowability improvers, and other known additives, all particular to the machine or engine in which the toner will be used.

Charge Control Agents

Charge control agents may be added to a toner for the purpose of making the toner product more electronegative or more electropositive. Whether the toner needs to be made more electronegative or more electropositive is determined by several factors. Some of these factors include the electronegativity of the remaining toner components as combined. Different colorants (polymeric colorants or dyestuff and pigments) and resins may impart different charge characteristics to the toner composition. The carrier, if one will be used, must be considered, as many carrier materials impart a charge to the toner composition. The machine in which the toner is used may impart some charge to the toner. The purpose of the charge control agent component of the toner is to stabilize the toner with respect to electrical charge. This avoids problems of print quality, color balance, and fogging, which are associated with too much or too little charge on the toner particles.

Examples of positive charge control agents that may be used include nigrosine dyes, quaternary ammonium salts, and resins containing quaternary ammonium salts and/or resins having amino groups.

Examples of the negative charge control agents that may be employed include trimethylethane dyes, metal complex salts of salicylic acids, metal complex salts of benzilic acid, copper phthalocyanine, perylene, quinacridone, azo pigment, metal complex salt azo dye, heavy metal (such as chromium, zinc, or aluminum)-containing acidic dye such as azochrome complex, calixarene type phenol condensate, cyclic polysaccharide, and resins containing carboxyl groups or sulfonyl groups.

Charge control agents may be metal-containing complexes or nitrogen containing compounds. They may impart a desired charge to the toner, which either counteracts the charge imparted by other toner components or enhances the same, depending on the components and the agent used.

Charge control agents suitable for use in the inventive toner product herein include negative charge control agents such as those commercially available from Orient Chemicals under the trade names S-34, S-54, E-84, and E-88; those available from Hodagaya Chemical under the trade names TRH, T-77, T-95 and TNS-2; those available commercially from Japan Carlit under the trade name LR-147, and LR-120, those available from Zeneca under the trade designation CCA-7, and other such materials available from BASF and others.

Commercially available positive charge control agents, which may also be used, include nigrosine compounds available commercially from Orient Chemicals under the trade designation N-01, N-02, N-03, N-04, N-05S, N-06, N-07, N-08, N-09, N-10, N-11, N-12 and N-13, and cetyl pyridinium chloride (CPC) available commercially from several suppliers, and other quaternary ammonium compounds. Also, certain dyes, such as Copy Blue PR sold commercially by Hoechst/Clariant, may be included to contribute a positive charge affect to the toner.

These charge control agents may be used alone or in combination and good charge properties can be obtained by mixing with the binder resin in the amount within a range of 0.1-5 parts by weight.

Developer Compositions

Developer compositions comprising the polymeric colorants of the present invention may be employed. The developer composition may include the color toner and carrier particles. Non-coated carrier composed of particles of a magnetic material such as iron, ferrite, or the like may be used. Alternatively, a resin coated carrier may be used, in which the surface of such magnetic particles are covered with a resin. The average diameter of the carrier particles may be 15 to 150 microns in a volume average diameter. Illustrative examples of carrier particles that can be selected for mixing with the aforementioned colored toner composition of the present invention include those substances that are capable of electrically obtaining a charge of opposite polarity to that of the toner particles. The carrier particles of the present invention may be selected with a negative polarity causing the toner particles, which are positively charged, to adhere to and surround the carrier particles. Illustrative examples of carrier materials include granular zircon, granular silicon, polymethylmethacrylate, glass, steel, nickel, iron, ferrites, silicon dioxide, and the like.

Preparation of Toners of the Invention

A number of processes may be used to prepare the toner compositions, such as for example a pulverization process and chemical polymerization processes. The pulverization method has mainly been employed as the method of producing a powdered toner, such as those wherein a binder resin or a resin blend is mixed with polymeric colorants and optionally pigments and/or dyes, charge control agent and other components to form a first mixture. Then, the first mixture is mixed by means of a machine such as a ball mill.

Following mixing, the first mixture may be heated and melt kneaded or extruded then cooled down, pelletized, and pulverized to provide toner particles with an average volume particle diameter of from 9 to 20 microns, and with a broad geometric size distribution of 1.3 to 1.7. Optionally, the resulting fine powder toner is continued to pass through an air classifier, mainly to selectively remove the ultra-fine particles, usually those smaller than 5 microns, which may be detrimental to the electrophotographic process.

Chemical processes also may be used to produce the toner composition of the invention. The suspension polymerization method may comprise uniformly dissolving and dispersing a monomer, a polymerization initiator, a polymeric colorant and a charge control agent. These items may be added to the mixture in an aqueous medium in the presence of a dispersion stabilizer while stirring to form oil droplets and polymerizing the monomer to obtain toner particles. The color toners containing polymeric colorants may be highly transparent. This may facilitate the multi-step printing process to achieve high resolution of the print. The liquid or paste nature of the polymeric colorant may facilitate ease of handling during the color toner manufacturing processes including pulverization processes and chemical processes.

The flexibility of polymer chain(s) of the polymeric colorants may be designed or modified to be compatible with almost any polymer, thus enabling a wide selection of thermoplastics to be chosen as the binder resins for color toner applications. The color toners containing polymeric colorants in general have low to no bleeding and migration due to the excellent compatibility between the colorants and the binder resins. The liquid or paste nature of the polymeric colorants may facilitate the color manufacturing process (pulverization and chemical processes) to be much less dusty and therefore highly desirable compared with conventional dyes and pigments in color toners.

The improved water washability of the polymeric colorants and color toners may enable one to easily clean the manufacturing equipment, thus enabling a more cost effective manufacturing process. The inherent characteristics of the polymeric colorants may enable different polymeric colorants to be completely compatible. The inherent characteristics of the polymeric colorants may enable the color toners containing polymeric colorants of general formulas (I) and (III) may have a brighter color shade than those containing conventional pigments.

As an example for the production processes, the color toner particles of the present invention may be produced by thoroughly mixing a thermoplastic resin with at least one polymeric colorant of the general formulas (I) and (III), a charge control agent and other additives by means of a mixing machine such as a ball mill, thereafter melt-kneading the mixture using a heat kneading machine such as a heat roll or an extruder to make resins melt together. This may be followed by dispersing or dissolving a colorant in the molten product, and solidifying it by cooling, followed by pulverization. The pulverization manufacturing process of the color toners containing polymeric colorants may or may not consist of a strict classification step to obtain desired color toners. In other applications, it is possible to actually co-polymerize a polymeric colorant with a resin or polymer, thereby forming a colored thermoplastic co-polymer resin.

The imaging methods in the industry may benefit from the compositions of the invention. For example, there are provided methods wherein a color image is repeatedly formed on a photoreceptor and thereafter, the resulting images are transferred to form the color image. In other instances, an image may be formed on a photoreceptor and successively transferred to an intermediate transfer member. Then, a color image may be formed on the intermediate transfer member. Thereafter, the color image may be formed by transferring the resulting color image to an image forming material such as paper.

Synthesis of Polymeric Colorants

EXAMPLE 1

Aniline 2EO/15PO/5EO (67.5 g) is reacted with acetic anhydride (17.2 g) while heating. After stripping to remove acetic acid and excess of acetic anhydride, the resulting mixture is then allowed to react with a mixture of DMF (13.5 g) and $POCl_3$ (11 g) in the presence of acetic anhydride (1.3 g). Upon heating to 90° C. for 2 h under nitrogen protection, the mixture is washed with hot water, and the product layer is collected and charged with a mixture of 50% caustic, water and 45% KOH, and heated for a few hours. Upon workup, the resulting residue intermediate is reacted with ethyl cyanoacetate (7.5 g) in the presence of ammonium carbonate (0.4 g). After work up, a liquid product (90% yield) is obtained with color value of 35 abs./g/L (in methanol) at 423 nm.

EXAMPLE 2

To a stirring solution of water (23.0 g) and 93% sulfuric acid (35.0 g) is added with 4,4'-diaminodiphenylsulfone (10.8 g). The resulting reaction mixture is allowed to react with nitrosylsulfuric acid (40%, 31.0 g). The bis-diazonium salt solution is then reacted with a mixture of m-toluidine 2EO/10PO/6EO (89.8 g), water (45.0 g), and urea (2.0 g). The red reaction mixture is allowed to stir for a period of time, after which 50% caustic (60 g) was added to adjust the pH to greater than 7. The resulting product layer is separated, washed several times with hot water and stripped via rotary evaporator to give an orange oil with a color value of 27 abs./g/L (in MeOH) at 471 nm.

EXAMPLE 3

Using the procedure similar to that as described in EXAMPLE 2, 2-amino-4-methylbenzothiazole (16.4 g) is allowed to react with m-toluidine 2EO/10PO/6EO (1 eq.) to obtain an orange liquid with a color value of 53 abs./g/L (in methanol) at 512 nm.

EXAMPLE 4

Using the procedure similar to that as described in EXAMPLE 2, 5-amino-3-methyl-2,4-thiophenedicarbonitrile (11.3 g) is allowed to react with m-toluidine 2EO/14PO/8EO (94 g) in the presence of 85% H3PO4 to obtain an violet liquid with a color value of 29 abs./g/L (in methanol) at 570 nm.

EXAMPLE 5

Aniline 2EO/13PO (131 g), 93% $H_2SO_4$ (3.6 g), orthoformylbenzenesulfonic acid sodium salt (14.6 g), water (10 g), urea (0.1 g) and ammonium meta-vanadate (0.71 g) are charged into an flask, the whole mixture is heated for 4 hours and then is charged with a mixture of 30% $H_2O_2$ (18 g) and water (18 g). Upon holding at 75° C. for 1 hour, the reaction mixture is cooled down and washed with hot water. After the removal of water, a dark blue liquid is obtained with a color value of 53 abs./g/L (in methanol) at 630 nm.

EXAMPLE 6

A black polymeric colorant is obtained by thoroughly blending 20.2% of yellow colorant from Example 1 at an adjusted color value of 27, 21.2% of red colorant from Example 3 at an adjusted color value of 30 abs./g/L, 6.7% of violet colorants from Example 4 at an adjusted color value of 24, and 51.9% of blue colorant from Example 5 at an adjusted color value of 25 abs./g/L.

Preparing Inventive Color Toners

EXAMPLE 7

Negatively Charged Inventive Yellow Toner NNY-7

86 parts (grams) of styrene acrylic copolymer resin having $M_w$ of $23\times10^4$~$24\times10^4$ and $T_g$ of 69° C. and $T_f$ of 133° C., is thoroughly mixed with 4 parts of synthetic hard paraffin wax (Fischer-Tropsch wax). The above resin blend, 2.0 parts of polymeric yellow colorant from Example 1 and 3.5 parts of Pigment Yellow 12, are mixed with 1 part of charge control agent oxy carboxylic acid compound Bontron® E-84 (from Orient Chemical), 2 parts of low molecular weight polypropylene wax, and 1 part of silica R202 (from Degussa) in a PCM 30 twin screw extruder. The whole mixture is heated and melt-kneaded at 120-135° C., crushed, then pulverized by a jet mill, resulting in fine particles with diameters of approximately 6-8 micron (volume average). The particle mixture is then put into a refrigerated blender with 0.1 parts of alumina for improving the drum cleaning, and with 1 part of silica TG308 (from Cabot) to improve flowability, and packaged in an electrostatic bag to prevent the loss of electrical charge.

EXAMPLE 8

Negatively Charged Inventive Red Toner NNR-8

The same procedure as in Example 7 is repeated with the exception that the polymeric yellow colorant from Example 1 and Pigment Yellow 12 are replaced with polymeric red colorant from Example 3 (2.5 parts) and Pigment Red 122 (3.0 parts).

EXAMPLE 9

Negatively Charged Inventive Blue Toner NNB-9

The same procedure as in Example 7 is repeated with the exception that the polymeric yellow colorant from Example 1 and Pigment Yellow 12 are replaced with polymeric blue colorant from Example 5 (2.5 parts) and C.I. Pigment Blue 15:3 (3.0 parts).

EXAMPLE 10

Negatively Charged Inventive Black Toner NNBK-10

The same procedure as in Example 7 is repeated with the exception that the polymeric yellow colorant from Example 1 and Pigment Yellow 12 are replaced with polymeric black colorant from Example 6 (2.0 parts), Carbon Black (6.0 parts) and Solvent Black 27 (1.0 parts), respectively.

EXAMPLE 11

Positively Charged Inventive Yellow Toner PNY-11

The same procedure as in Example 7 is repeated with the exception that the negative charge control agent oxy carboxylic acid compound is replaced with a positive charge control agent quaternary ammonium salt (1 part), and the silica R202 and TG308 are replaced with silica TG820G (from Cabot).

EXAMPLE 12

Positively Charged Inventive Red Toner PNR-12

The same procedure as in Example 8 is repeated with the exception that the negative charge control agent oxy carboxylic acid compound is replaced with a positive charge control agent quaternary ammonium salt (1 part), and the silica R202 and TG308 are replaced with silica TG820G (from Cabot).

EXAMPLE 13

Positively Charged Inventive Blue Toner PNB-13

The same procedure as in Example 9 is repeated with the exception that the negative charge control agent oxy carboxylic acid compound is replaced with a positive charge control agent quaternary ammonium salt (1 part), and the silica R202 and TG308 are replaced with silica TG820G (from Cabot).

EXAMPLE 14

Positively Charged Inventive Black Toner PNBK-14

The same procedure as in Example 10 is repeated with the exception that the negative charge control agent oxy carboxylic acid compound is replaced with a positive charge control agent quaternary ammonium salt (1 part), and the silica R202 and TG308 are replaced with silica TG820G (from Cabot).

EXAMPLE 15

Negatively Charged Inventive Yellow. Toner NNY-15

86 parts (grams) of styrene acrylic copolymer resin having $M_w$ of $23\times10^4$~$24\times10^4$ and $T_g$ of 69° C. and $T_f$ of 133° C., is thoroughly mixed with 4 parts of synthetic hard paraffin wax (Fischer-Tropsch wax). The above resin blend, 5.0 parts of polymeric yellow colorant from Example 1 and 0.5 parts of polymeric orange colorant from Example 2, are mixed with 1 part of charge control agent oxy carboxylic acid compound (Bontron® E-84), 2 parts of low molecular weight polypropylene wax, and 1 part of silica R202 (from Degussa) in a PCM 30 twin screw extruder. The whole mixture is heated and melt-kneaded at 120-135° C., crushed, then pulverized by a jet mill, resulting in fine particles with diameters of approximately 6-8 micron (volume average). The particle mixture is then put into a refrigerated blender with 0.1 parts of alumina for improving the drum cleaning, and with 1 part of silica TG308 (from Cabot) to improve flowability, and packaged in an electrostatic bag to prevent the loss of electrical charge.

EXAMPLE 16

Negatively Charged Inventive Red Toner NNR-16

The same procedure as in Example 15 is repeated with the exception that the polymeric yellow colorant from Example 1 and the polymeric orange colorant from Example 2 are replaced with a total of 5 parts of polymeric red colorant from Example 3.

EXAMPLE 17

Negatively Charged Inventive Violet Toner NNV-17

The same procedure as in Example 15 is repeated with the exception that the polymeric yellow colorant from Example 1 and the polymeric orange colorant from Example 2 are replaced with a total of 5 parts of polymeric violet colorant from Example 4.

EXAMPLE 18

Negatively Charged Inventive Blue Toner NNB-18

The same procedure as in Example 15 is repeated with the exception that the polymeric yellow colorant from Example 1 and the polymeric orange colorant from Example 2 are replaced with a total of 5 parts of polymeric blue colorant from Example 5.

EXAMPLE 19

Negatively Charged Inventive Black Toner NNBK-19

The same procedure as in Example 15 is repeated with the exception that the polymeric yellow colorant from Example 1 and the polymeric orange colorant from Example 2 are replaced with a total of 5 parts of polymeric black colorant from Example 6.

EXAMPLE 20

Positively Charged Inventive Yellow Toner PNY-20

The same procedure as in Example 15 is repeated with the exception that the negative charge control agent oxy carboxylic acid compound is replaced with 1 part of a positive charge control agent quaternary ammonium salt, and the silica R202 and TG308 are replaced with silica TG820G (from Cabot).

EXAMPLE 21

Positively Charged Inventive Red Toner PNR-21

The same procedure as in Example 16 is repeated with the exception that the negative charge control agent oxy carboxylic acid compound is replaced with 1 part of a positive charge control agent quaternary ammonium salt, and the silica R202 and TG308 are replaced with silica TG820G (from Cabot).

EXAMPLE 22

Positively Charged Inventive Violet Toner PNV-22

The same procedure as in Example 17 is repeated with the exception that the negative charge control agent oxy carboxylic acid compound is replaced with 1 part of a positive charge control agent quaternary ammonium salt, and the silica R202 and TG308 are replaced with silica TG820G (from Cabot).

EXAMPLE 23

Positively Charged Inventive Blue Toner PNB-23

The same procedure as in Example 18 is repeated with the exception that the negative charge control agent oxy carboxylic acid compound is replaced with 1 part of a positive charge control agent quaternary ammonium salt, and the silica R202 and TG308 are replaced with silica TG820G (from Cabot).

EXAMPLE 24

Positively Charged Inventive Black Toner PNBK-24

The same procedure as in Example 19 is repeated with the exception that the negative charge control agent oxy carboxylic acid compound is replaced with 1 part of a positive charge control agent quaternary ammonium salt, and the silica R202 and TG308 are replaced with silica TG820G (from Cabot).

EXAMPLE 25

Negatively Charged Inventive Yellow Toner NNY-25 (with Classification)

86 parts (grams) of styrene acrylic copolymer resin having $M_w$ of $23\times10^4$~$24\times10^4$ and $T_g$ of 69° C. and $T_f$ of 133° C., is thoroughly mixed with 4 parts of synthetic hard paraffin wax (Fischer-Tropsch wax). The above resin blend, 2.0 parts of polymeric yellow colorant from Example 1 and 3.5 parts of Pigment Yellow 12, are mixed with 1 part of charge control agent oxy carboxylic acid compound (Bontron® E-84), 2 parts of low molecular weight polypropylene wax, and 1 part of silica R202 (from Degussa) in a PCM 30 twin screw extruder. The whole mixture is heated and melt-kneaded at 120-135° C., crushed, then pulverized by a jet mill, resulting in fine particles with diameters of approximately 6-8 micron (volume average). The resulting fine powder toner particles are passed through an air classifier to selectively remove ultra-fine and very coarse particles. The toner particles thus collected are then put into a refrigerated blender with 0.1 parts of alumina for improving the drum cleaning, and with 1 part of silica TG308 (from Cabot) to improve flowability, and packaged in an electrostatic bag to prevent the loss of electrical charge.

EXAMPLE 26

Positively Charged Inventive Yellow Toner PNY-26 (with Classification)

The same procedure as in Example 26 is repeated with the exception that the negative charge control agent oxy carboxylic acid compound is replaced with 1 part of a positive charge control agent quaternary ammonium salt compound, and the silica R202 and TG308 are replaced with silica TG820G (from Cabot).

EXAMPLE 27

Negatively Charged Inventive Red Toner NNR-27 (with Classification)

86 parts (grams) of styrene acrylic copolymer resin having $M_w$ of $23\times10^4$~$24\times10^4$ and $T_g$ of 69° C. and $T_f$ of 133° C., is thoroughly mixed with 4 parts of synthetic hard paraffin wax (Fischer-Tropsch wax). The above resin blend and 5.0 parts of polymeric red colorant from Example 1 are mixed with 1 part of charge control agent oxy carboxylic acid compound (Bontron® E-84), 2 parts of low molecular weight polypropylene wax, and 1 part of silica R202 (from Degussa) in a PCM 30 twin screw extruder. The whole mixture is heated and melt-kneaded at 120-135° C., crushed, then pulverized by a jet mill, resulting in fine particles with diameters of approximately 6-8 micron (volume average). The resulting fine powder toner particles are passed through an air classifier to selectively remove ultra-fine and very coarse particles. The toner particles thus collected are then put into a refrigerated blender with 0.1 parts of alumina for improving the drum cleaning, and with 1 part of silica TG308 (from Cabot) to improve flowability, and packaged in an electrostatic bag to prevent the loss of electrical charge.

EXAMPLE 28

Positively Charged Inventive Red Toner PNR-28 (with Classification)

The same procedure as in Example 27 is repeated with the exception that the negative charge control agent oxy carboxylic acid compound is replaced with 1 part of a positive charge control agent quaternary ammonium salt compound, and the silica R202 and TG308 are replaced with silica TG820G (from Cabot).

Production of Comparative Color Toners

EXAMPLE 29

Negatively Charged Comparative Yellow Toner NNY-29

86 parts (grams) of styrene acrylic copolymer resin having $M_w$ of $23\times10^4$~$24\times10^4$ and $T_g$ of 69° C. and $T_f$ of 133° C., is thoroughly mixed with 4 parts of synthetic hard paraffin wax (Fischer-Tropsch wax). The above resin blend and 3.5 parts of Pigment Yellow 12, are mixed with 1 part of charge control agent oxy carboxylic acid compound (Bontron® E-84), 2 parts of low molecular weight polypropylene wax, and 1 part of silica R202 (from Degussa) in a PCM 30 twin screw extruder. The whole mixture is heated and melt-kneaded at 120-135° C., crushed, then pulverized by a jet mill as the same process in Example 7, resulting in fine particles. The particle mixture is then put into a refrigerated blender with 0.1 parts of alumina for improving the drum cleaning, and with 1 part of silica TG308 (from Cabot) to improve flowability, and packaged in an electrostatic bag to prevent the loss of electrical charge.

EXAMPLE 30

Negatively Charged Comparative Red Toner NNR-30

The same procedure as in Example 29 is repeated with the exception that the C.I. Pigment Yellow is replaced with 3.6 parts of C.I. Pigment Red 122.

EXAMPLE 31

Negatively Charged Comparative Blue Toner NNB-31

The same procedure as in Example 29 is repeated with the exception that the C.I. Pigment Yellow is replaced with 3.5 parts of C.I. Pigment Blue 15:3.

EXAMPLE 32

Negatively Charged Comparative Black Toner NNBK-32

The same procedure as in Example 29 is repeated with the exception that the C.I. Pigment Yellow is replaced with 6.0 parts of Carbon Black and 1 part of Solvent Black 27.

EXAMPLE 33

Positively Charged Comparative Yellow Toner PNY-33

The same procedure as in Example 29 is repeated with the exception that the negative charge control agent oxy carboxylic acid compound is replaced with 1 part of positively charge control agent quaternary ammonium salt compound, and the silica R202 and TG308 are replaced with silica TG820G (from Cabot).

EXAMPLE 34

Positively Charged Comparative Red Toner PNR-34

The same procedure as in Example 30 is repeated with the exception that the negative charge control agent oxy carboxylic acid compound is replaced with 1 part of positively charge control agent quaternary ammonium salt compound, and the silica R202 and TG308 are replaced with silica TG820G (from Cabot).

EXAMPLE 35

Positively Charged Comparative Blue Toner PNB-35

The same procedure as in Example 31 is repeated with the exception that the negative charge control agent oxy carboxylic acid compound is replaced with 1 part of positively charge control agent quaternary ammonium salt compound, and the silica R202 and TG308 are replaced with silica TG820G (from Cabot).

EXAMPLE 36

Positively Charged Comparative Black Toner PNBK-36

The same procedure as in Example 32 is repeated with the exception that the negative charge control agent oxy carboxylic acid compound is replaced with 1 part of positively charge control agent quaternary ammonium salt compound, and the silica R202 and TG308 are replaced with silica TG820G (from Cabot).

Characterization of Inventive and Comparative Color Toners

1. Particle Size Distribution of Color Toners

Particle size measurements are conducted using a laser light scattering instrument. The size distribution is calculated from a diffraction pattern that develops because of laser light interacting with the particles. The angles at which the light is scattered in combination with the intensities of the scattered light are measured by a light-sensitive detector system. The electrical values developed by the detector system are used to calculate the volume of particles as a function of particle size. The distribution provides the opportunity to calculate percentiles in order to divide the distribution into specific percentage amounts. These values are used to specify product particle size characteristics. The instrument used is the Microtrac X100.

The procedure requires that a representative sample of the toner powder is dispersed and introduced to the fluid circulation system using a fluid that will not dissolve the powder. In this case, water containing 1% (wt.) Triton X-100 is used to disperse the toner. Triton X-100 is a nonionic surfactant supplied by the Union Carbide Subsidiary of the Dow Chemical Company. Agitation and ultrasonic energy are used to wet the powder and disperse agglomerates which may be present. The instrument is activated to collect the scattered laser light and calculate the particle size distribution and various distribution features such as the tenth, fiftieth, and ninetieth percentiles. These parameters are used to describe the fine, medium, and coarse fractions of the volume based particle size distribution. The tenth percentile is the size that is larger than the finest ten percent of the particles in the distribution and smaller than the largest ninety percent of the distribution. The tenth, fiftieth, and ninetieth percentiles are commonly referred to as the D10, D50, and D90 respectively.

More specifically, 0.3-0.4 grams of toner powder are added to 125 ml of the dilute (1% aqueous) Triton X-100 surfactant in a 250 ml glass beaker. The powder suspension is stirred at 600 rpm for 3 minutes using a 30 mm turbine agitator to wet and disperse the particles. The suspension is transferred to an ultrasonic bath for 2 minutes to ensure that loose agglomerates are dispersed and then placed under the agitator again to uniformly suspend the particles in the surfactant. Approximately 5 ml of the toner suspension are transferred to the Microtrac X100 laser light scattering (LLS) device for analysis.

The LLS device has a circulation system and the detection unit. The circulation system employed contains 250 ml. of water and uses a pump and an internal ultrasonic probe to suspend and disperse the particles. The detection unit contains the laser(s) and a photodiode array. Laser light is focused through the clear flow cell which contains the circulating powder suspension and the scattered light signals are measured by the silicon light sensitive detector.

Calculations are performed on the scattered light signals that are measured by a silicon light sensitive detector system. To correct for light scattering optical effects that occur as a property of the material in relation to the suspending fluid, Mie scattering calculations or modifications are used. These calculations include the use of refractive index of the powder material and the suspending fluid. The refractive index of water is documented to be 1.33. The refractive index used for the powder toner is 1.7. And the results are summarized in Table 1.

TABLE 1

Particle Size Distribution of Inventive and Comparative Color Toners

| Color Toner | D10 (micron) | D50 (micron) | D90 (micron) |
|---|---|---|---|
| NNY-7 | 3.88 | 6.89 | 10.44 |
| NNR-8 | 3.52 | 6.26 | 9.47 |
| NNB-9 | 4.26 | 7.49 | 11.98 |
| NNBK-10 | 4.96 | 8.13 | 12.86 |
| NNY-29 | 3.56 | 5.58 | 8.31 |
| NNR-30 | 3.59 | 6.12 | 9.27 |
| NNB-31 | 3.28 | 6.22 | 10.25 |
| NNBK-32 | 4.00 | 6.10 | 9.31 |

2. Glass Transition Temperatures of the Inventive Color Toners

The glass transition temperatures of the color toners were measured by DSC at 10° C./minute, and the results are summarized in Table 2.

TABLE 2

Inventive Toner Glass Transition Temperatures

| Color Toner | Testing | | |
|---|---|---|---|
| | Inflection Point (Degree C.) | Peak (Degree C.) | Others (Degree C.) |
| NNY-7 | 47.6 | 58.5 | 97.9 |
| NNR-8 | 60.1 | 65.1 | 98.5 |
| NNB-9 | 55.3 | 61.7 | 98.0 |
| NNBK-10 | 58.4 | 63.8 | 99.1 |
| PNR-21 | 51.7 | 57.6 | 100.3 |
| PNBK-24 | 48.0 | 54.5 | 98.1 |

3. Color Toner Softening Points

The softening points of the inventive color toners were determined at the condition of 1×1 die, wt 20 kgf and 6° C./minute. The results are summarized in Table 3.

TABLE 3

Softening Points of Color Toners

| Color Toner Sample | Softening Point (C.) |
|---|---|
| NNY-7 | 116.6 |
| NNR-8 | 126.5 |
| NNB-9 | 123.5 |
| NNBK-10 | 122.8 |
| PNY-20 | 120.0 |
| PNR-21 | 121.0 |
| PNB-23 | 122.0 |
| PNBK-24 | 123.0 |

4. Molecular Weight of Inventive Color Toners

The molecular weight of the color toners were measured by GPC. The results are summarized in Table 4.

TABLE 4

Molecular Weight of the Inventive Color Toners

| Color Toner | Mw * $10^4$ | Mn * $10^4$ | Mw/Mn | LP peak * $10^4$ | HP peak * $10^4$ | HP % |
|---|---|---|---|---|---|---|
| NNY-7/PNY-20 | 17 | 0.9 | 19.5 | 1.2 | 47.7 | 26.8 |
| NNR-8/PNR-21 | 18.8 | 1.0 | 19.6 | 1.4 | 28.5 | 26.7 |
| NNB-9/PNB-23 | 17.7 | 0.9 | 20.1 | 1.3 | 33.1 | 25.8 |
| NNBK-10/ PNBK-24 | 15.9 | 1.1 | 15.1 | 1.4 | 35.2 | 26.4 |

5. Triboelectric Charge of Inventive Color Toners

The triboelectric charges of the inventive color toners were measured using blow-off method at T/D=5% and carrier FB-100S. The results are summarized in Table 5.

TABLE 5

Triboelectric Charge of Inventive Color Toners

| Color Toner | Micro coulomb/gram | |
|---|---|---|
| | Rotation Time (5 min) | Rotation Time (30 min) |
| NNY-7 | −25.0 | −24.6 |
| NNR-8 | −18.4 | −14.5 |
| NNB-9 | −51.2 | −54.7 |
| NNBK-10 | −21.8 | −17.0 |
| PNY-20 | +20.0 | +19.0 |
| PNR-21 | +18.2 | +15.0 |
| PNB-23 | +50.2 | +50.2 |
| PNBK-24 | +20.0 | +18.2 |

Performance Testing of the Inventive and Comparative Color Toners

6. Image Reproduction Test

The inventive and comparative color toners are tested on both Xerox Docucolor 12 and Xerox Acolor 635 color copiers for image reproduction. Each color toner is transferred into a toner canister and multiple copies of the original are made. The copied image is evaluated as compared with the original. The results are listed in Table 6.

TABLE 6

Image Reproduction Test for Inventive and Comparative Color Toners

| Color Toner | Image Color Brightness | Solid Image Uniformity | Background/Fog |
|---|---|---|---|
| NNY-7 | Excellent | Excellent | None |
| NNR-8 | Good | Excellent | None |
| NNB-9 | Excellent | Excellent | None |
| NNBK-10 | N/A | Excellent | None |
| NNY-29 | Average | Average | Occur |
| NNR-30 | Average | Average | Occur |
| NNB-31 | Average | Average | Occur |
| NNBK-32 | Average | Average | Occur |

7. Color Hues

Proofing Ink References for Web Offset and Halftone Gravure—Specifications Web Offset Publications (SWOP) Hi-Lo Color References are purchased. The Hi-Lo Color References are measured with an X-Rite 938 spectrodensitometer and calculated the average. The Proofing Ink References are photocopied on a Xerox Docucolor 12 color copier at the standard setting using Xerox toner.

The Xerox toner canisters are removed and copies were made until the color copier indicated that the four colors had been emptied. In order to get the copier to work, it was necessary to load an inventive toner as each color ran out. After all the Xerox toner had emptied, over 50 photocopies were made before making test copies. The test copies were made at the standard copier setting.

The process is repeated for the comparative set of color toners. The test toner was removed from the canisters and the residual removed with a shop vacuum. The comparative set of color toners are added to the empty canisters. The color hues for the inventive color toners are shown in FIG. 1.

The invention has been described in detail in connection with numerous embodiments; however modifications to those embodiments will be readily apparent to those of skill in the art. For example, while the inventive toners have been described in connection with a styrene acrylic copolymer resin, other resins which are commonly used for color toners, such as polyester etc, may also be used. Such modifications are within the spirit and scope of the present invention which is set forth in the appended claims.

The invention claimed is:

1. A color toner composition adapted for electrophotographic printing comprising:

(a) a thermoplastic resin;

(b) a charge control agent; and (c) a polymeric colorant, said polymeric colorant being selected from the group consisting of methine-based colorants, azo-based colorants, benzodifuranone-based colorants, and triphenylmethane-based colorants, and said polymeric colorant conforming to the structure of formula (I):

$$R\text{-}[E\text{-}(Z\text{-}X)_n]m \quad (I)$$

wherein R or R-E is an organic chromophore, E is a linking moiety selected from the group consisting of N, O, S, $SO_3$, $SO_2N$, and $CO_2$, n and m are independently selected from the group consisting of integers from 1 to 5, each Z is an oligomeric constituent independently selected from the group consisting of:

(i) divalent oligomeric alkylene oxide radicals having a molecular weight of 44 to about 3000, the divalent oligomeric alkylene oxide radical comprising monomers selected from the group consisting of ethylene oxide, propylene oxide, butylene oxide, glycidol, and combinations thereof, (ii) divalent aliphatic oligomeric esters conforming to structure (II)

(II)

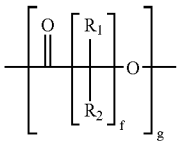

wherein each $R_1$ and $R_2$ are independently selected from the group consisting of H and $C_1$-$C_{10}$ alkyl groups, f is an integer from 1 to 10, and g is any positive integer from 1 to 20, and (iii) combinations of (i) and (ii);

wherein each X is an end group independently selected from the group consisting of H, OH, SH, $NH_2$, alkyl groups, aryl groups, alkyl ester groups, aryl ester groups, organic sulfonate groups, organic sulfate groups, and amide groups.

2. The color toner composition of claim 1 wherein said thermoplastic resin and said polymeric colorant are co-polymerized.

3. The color toner composition of claim 1 wherein said thermoplastic resin is selected from a group consisting of polyester, polyacrylate, styrene acrylate copolymer, polypropylene, polystyrene, hard paraffin wax, styrene butadiene copolymer, polyamide, and polyurethane.

4. The color toner composition of claim 1 wherein said thermoplastic resin comprises a blend of styrene acrylic copolymer resin and a hard paraffin wax.

5. The color toner composition of claim 1 wherein said thermoplastic resin comprises a styrene acrylate copolymer.

6. The color toner composition of claim 1, said composition further comprising:

(d) a wax.

7. The color toner composition of claim 6, wherein said wax comprises a low molecular weight polyethylene-based or polypropylene-based wax.

8. The color toner composition of claim 1, said composition further comprising:

(d) a pigment.

9. The color toner composition of claim 1 wherein said charge control agent is positively charged, thereby providing a positively charged color toner composition.

10. The color toner composition of claim 1 wherein said charge control agent is negatively charged, thereby providing a negatively charged color toner composition.

11. The color toner composition of claim 1, said composition being adapted for use as a developer composition, said developer composition additionally comprising:

(d) carrier particles, said carrier particles being magnetically active.

12. The color toner composition of claim 1, wherein said polymeric colorant is a methine-based colorant conforming to the structure of formula (IV):

(IV)

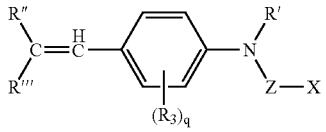

wherein R' is selected from the group consisting of hydrogen, alkyl groups, aryl groups, arylalkyl groups, alkylaryl groups, and groups having the structure -Z-X;

wherein each $R_3$ is independently selected from the group consisting of hydrogen, halogen atoms, alkyl groups, alkoxy groups, nitrile groups, nitro groups, amide groups, and sulfonamide groups, and q is an integer from 0 to 4; and wherein R" and R'" are independently selected from the group consisting of hydrogen, halogen atoms, tertiary amino groups, imine groups, cyano groups, pyridinium groups, ester groups, amide groups, sulfate groups, sulfonate groups, sulfide groups, sulfoxide groups, phosphine groups, phosphinium groups, phosphate groups, nitrile groups, mercapto groups, nitro groups, sulfone groups, acyl groups, azo groups, alkyl groups, alkoxy groups, aryl groups, aryloxy groups, arylalkyl groups, arylalkoxy groups, alkylaryl groups, and alkylaryloxy groups.

13. The color toner composition of claim 1, wherein said polymeric colorant is an azo-based colorant conforming to the structure of formula (V):

(V)

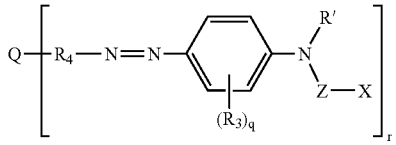

wherein R' is selected from the group consisting of hydrogen, alkyl groups, aryl groups, arylalkyl groups, alkylaryl groups, and groups having the structure -Z-X;

wherein each $R_3$ is independently selected from the group consisting of hydrogen, halogen atoms, alkyl groups, alkoxy groups, nitrile groups, nitro groups, amide groups, and sulfonamide groups, and q is an integer from 0 to 4;

wherein $R_4$ is selected from the group consisting of aromatic groups and heteroatom-containing aromatic groups;

wherein Q is hydrogen or a linking group selected from the group consisting of O, S, CO, $SO_2$, a $C_1$-$C_8$ alkyl group, a $C_2$-$C_8$ alkene group, a p-phenylenediamine group, a m-hydroxybenzene group, and a m-di($C_1$-$C_4$) alkoxybenzene group; and wherein r is 1 or 2.

14. The color toner composition of claim 1, wherein said polymeric colorant is a triphenylmethane-based colorant conforming to the structure of formula (VI):

(VI)

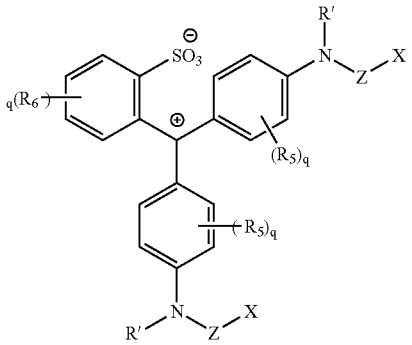

wherein R' is selected from the group consisting of hydrogen, alkyl groups, aryl groups, arylalkyl groups, alkylaryl groups, and groups having the structure -Z-X;

wherein each $R_5$ is independently selected from the group consisting of hydrogen, halogen atoms, alkyl groups, alkoxy groups, alkylamino groups, and arylamino groups;

wherein each $R_6$ is independently selected from the group consisting of hydrogen, halogen atoms, alkyl groups, alkoxy groups, alkylamino groups, arylamino groups, cyano groups, nitro groups, amide groups, $SO_3$, and sulfonamide groups, wherein each q is independently an integer from 0 to 4.

* * * * *